US007409992B2

(12) United States Patent
Zazovsky et al.

(10) Patent No.: US 7,409,992 B2
(45) Date of Patent: Aug. 12, 2008

(54) PERFORATING GUN

(75) Inventors: Alexander F. Zazovsky, Houston, TX (US); Vadim Akhmadikin, Pearland, TX (US); Wenbo Yang, Sugar Land, TX (US); Brenden M. Grove, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 162 days.

(21) Appl. No.: 11/306,785

(22) Filed: Jan. 11, 2006

(65) Prior Publication Data

US 2007/0158109 A1 Jul. 12, 2007

(51) Int. Cl.
*E21B 43/11* (2006.01)

(52) U.S. Cl. ..... 166/297; 166/298; 166/55

(58) Field of Classification Search ..... 166/297, 166/298, 55; 175/4.6
See application file for complete search history.

(56) References Cited

U.S. PATENT DOCUMENTS 3,242,987 A * 3/1966 Lebourg ..... 166/297
4,391,337 A * 7/1983 Ford et al. ..... 175/4.6
4,496,009 A 1/1985 DerMott et al.
7,172,023 B2 * 2/2007 Barker et al. ..... 166/297
2002/0185275 A1 12/2002 Yang et al.
2005/0194146 A1 9/2005 Barker et al.
2006/0118303 A1 * 6/2006 Schultz et al. ..... 166/297

OTHER PUBLICATIONS

Brown, J.E., Thrasher, R.W., Behrmann, L.A.; Fracturing Operations; Dowell Stimulation Handbook (Nolte & Economides: Reservoir Stimulation), 3rd edition, Chapter 11, pp. 1-33.

* cited by examiner

*Primary Examiner*—Jennifer H Gay
*Assistant Examiner*—Brad Harcourt
(74) *Attorney, Agent, or Firm*—Henry L. Ehrlich; Kevin B. McGoff; Bryan P. Galloway

(57) ABSTRACT

The present invention provides an apparatus for use in perforating a well having a plurality of explosive charges. Each explosive charge is adapted to generate a perforation tunnel in the formation adjacent to the well. In one embodiment, explosive charges are oriented to create perforation tunnels that converge at a location within the formation in order to create a fracture initiation plane capable of mitigating or avoiding hydraulic fracturing complications.

6 Claims, 6 Drawing Sheets

PERFORATING GUN

FIELD OF THE INVENTION

The present invention relates generally to well operations and, more particularly, to an apparatus for use in perforating a well.

BACKGROUND OF THE INVENTION

An apparatus, such as a perforating gun, may be lowered into a well and detonated to form fractures in the adjacent formation. After the perforating gun detonates, fluid typically flows into the well and to the surface via production tubing located inside the well.

SUMMARY OF THE INVENTION

The present invention provides an apparatus for use in perforating a well. In one embodiment, the present invention provides a perforating gun capable of being lowered into a well. The perforating gun of the present invention contains a plurality of explosive charges capable of creating perforation tunnels in the well and the adjacent formation upon detonation.

In one embodiment, at least one explosive charge is utilized to create a perforation tunnel in the formation through which fracturing fluid and proppant may be inserted. In one embodiment, the present invention provides one or more perforation tunnels wide enough to facilitate initial pressurization of the formation as well as proppant placement during the later stages of hydraulic fracturing.

In addition to one or more "wide" tunnels, additional explosive charges are utilized to create relatively narrow perforation tunnels in the formation. In this embodiment, such perforation tunnels are narrower than the "wide" tunnel(s) but travel a greater distance into the formation.

Explosive charges may be oriented so as to generate one or more "narrow" tunnels having tapering angles with respect to the longitudinal axis of the perforating gun. The orientation of the explosive charges facilitates the convergence of the "narrow" tunnel(s) and the "wide" tunnel(s) within the formation. The size, shape, grouping, and orientation of the explosive charges may also be altered to vary the convergence of the tunnels and their axes, depending on the specific requirements of the application.

In one embodiment, explosive charges are oriented within the perforating gun in order to facilitate the convergence of a plurality of tunnels and/or their longitudinal axes at some location within the formation at or beyond the endpoint of the "wide" tunnel. Creation of a fracture initiation area at or beyond the endpoint of the "wide" tunnel mitigates hydraulic fracturing complications such as fracture tortuosity, micro-annulus, and halo effect.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings; it being understood that the drawings contained herein are not necessarily drawn to scale; wherein.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

The present invention is herein described as an apparatus for use in perforating a well. Referring to the Figures, the present invention provides a perforating gun (12) capable of being lowered into a well (13). The perforating gun (12) of the present invention contains a plurality of explosive charges (14). Each charge, upon detonation, is capable of generating a perforation tunnel (T) in a formation (15) adjacent to the well (13). In one embodiment, perforation tunnels created by the explosive charges of the present invention have a non-linear configuration.

Figure 1:
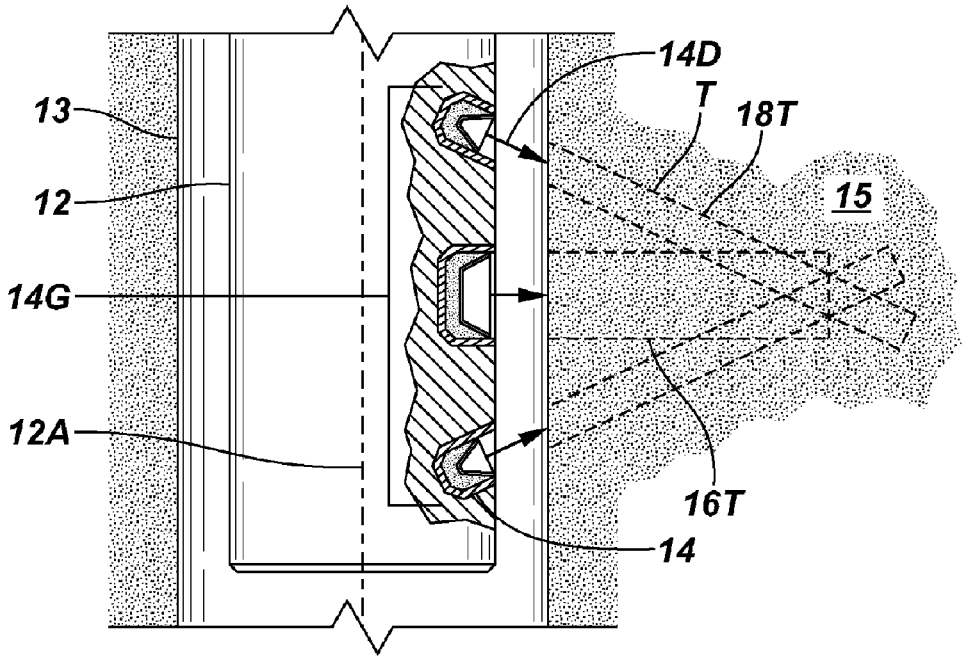
FIG. 1 is a cross-sectional view of a portion of a perforating gun of one embodiment of the present invention shown adjacent to a formation.
Figure 2:
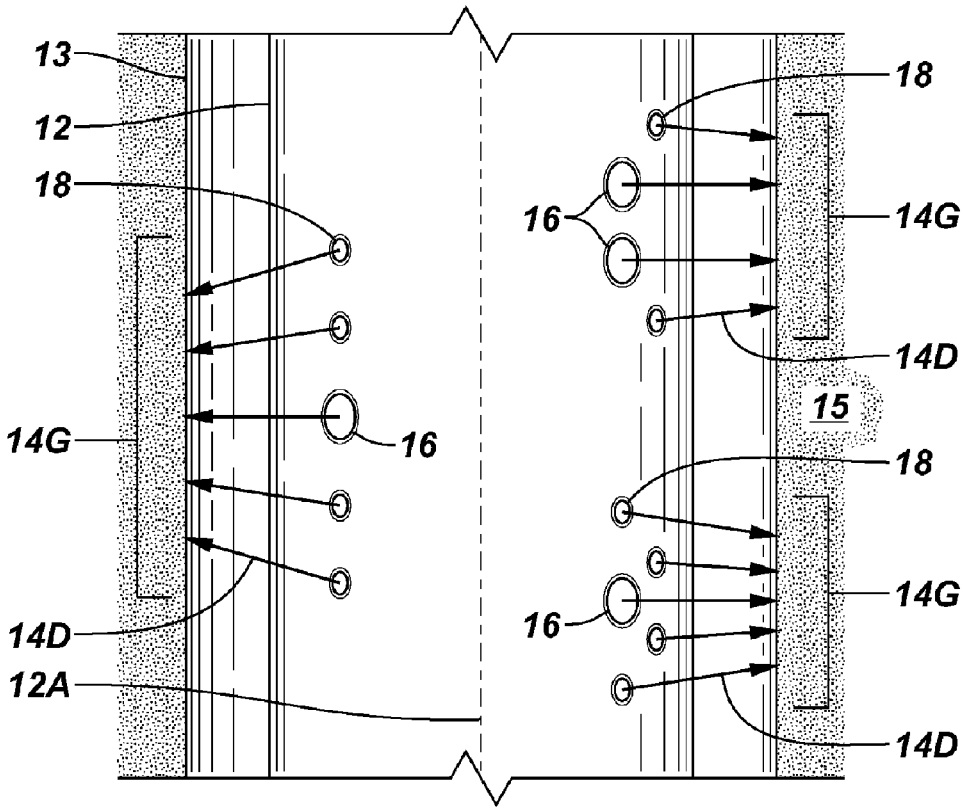
FIG. 2 is a cross-sectional view of a portion of a perforating gun of one embodiment of the present invention illustrating multiple explosive charge arrangements.
Figure 3:
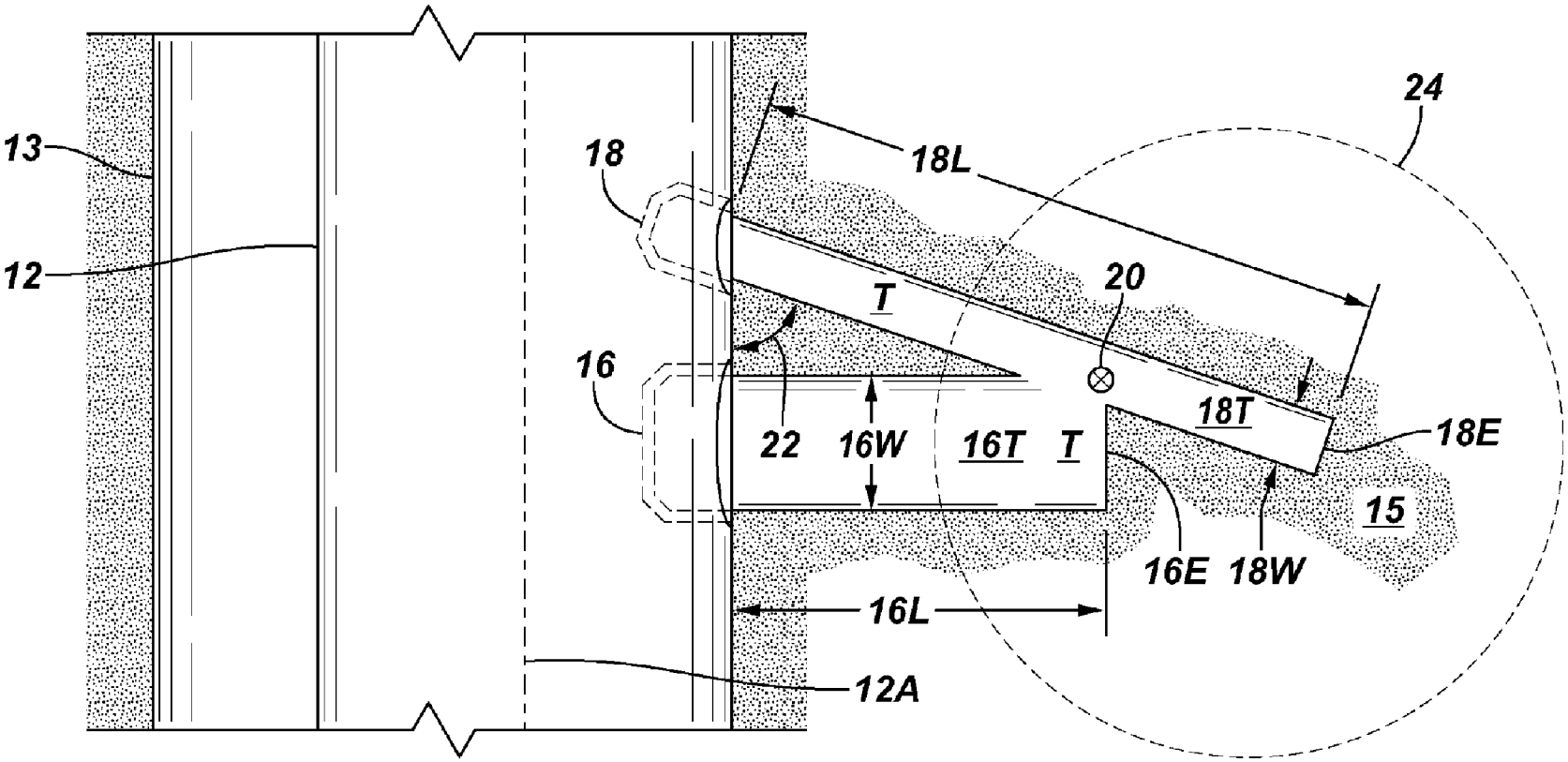
FIG. 3 is a cross-sectional view of a portion of a perforating gun of one embodiment of the present invention illustrating the intersection of perforation tunnels in an adjacent formation.

In one embodiment, explosive charges (14) are positioned with the perforating gun (12) so as to form groups or arrangements (14G) of explosive charges. Such arrangements are designed to create a series of perforation tunnels within the adjacent formation (15) upon detonation. Arrows labeled by reference numeral (14D) illustrate the expected explosive path of the explosive charges upon detonation in FIGS. 1 and 2.

It should be understood that such charge arrangements (14G) may be altered in order to adapt to the needs of particular perforating applications. Such alterations may include variations of explosive charge phasing, relative positioning of individual charges within an arrangement, variations of the number of explosive charge arrangements in any given section of the perforating gun, and/or variations of the number and type of explosive charges utilized in any given perforating gun section. Further, the detonation sequence of explosive charge arrangements may be altered to facilitate efficient perforation of the formation, as described in greater detail below.

In one embodiment, at least one explosive charge is oriented to radially direct explosive energy into the formation at an angle of about 90 degrees with respect to the longitudinal axis (12A) of the perforating gun (12). In one embodiment, the present invention provides at least one explosive charge (16) capable of creating a relatively wide perforation tunnel (16T) in the formation (15). In one embodiment, a "big hole" explosive charge (16) may be utilized to create the wide perforation tunnel (16T) contemplated by the present invention.

In one embodiment, the present invention provides at least one explosive charge (18) capable of creating a relatively narrow perforation tunnel (18T) in the formation (15). In this embodiment, the explosive charge capable of creating a relatively narrow perforation tunnel (18T) is oriented to direct explosive energy into the formation (15) at tapering angles (22) taken with respect to the longitudinal axis (12A) of the perforating gun. In one embodiment, a "deep penetrating" explosive charge (18) may be utilized to create the narrow perforation tunnel (18T) contemplated by the present invention. In one embodiment, the wide tunnel has width (16W), length (16L), and endpoint (16E), while the narrow tunnel has width (18W), length (18L), and endpoint (18E).

In one embodiment, explosive charges utilized by the present invention may be shaped charges. Further, the perforation tunnels of the present invention may have varying dimensions and cross sectional arrangements. In one embodiment, at least one wide tunnel is relatively wider and shorter than the narrow perforation tunnel(s). Likewise, the narrow tunnels are generally longer and narrower than the wide tunnels, as described further below.

The orientation of the explosive charge (18) allows the narrow perforation tunnel (18T) to intersect the wide perforation tunnel (16T) at some point within the formation (15). In one embodiment, the intersection of the perforation tunnels (16T and 18T, respectively) results in the creation of a fracture initiation area (24) in the general vicinity of the intersection (20).

In one embodiment, explosive charges are selected in order to encourage intersection of perforation tunnels in an area at or beyond the endpoint (16E) of the wide perforation tunnel (16T). In short, the intersection (20) of perforation tunnels (16T and 18T, respectively) at or beyond the endpoint of the wide tunnel creates an area (24) of weakened rock and increases the likelihood of fracture initiation and propagation at some point behind the end point (16E) of the wide tunnel. If fracture initiation occurs in an area (24) at or beyond the endpoint of the wide tunnel, the risk of fracture within the wide tunnel close to the wall of the wellbore is decreased due to the reduction of stresses in the area.

By encouraging fracture initiation in an area beyond the endpoint (16E) of the wide tunnel (16T), the present invention allows the wide tunnel to be utilized for initial pressurization of the formation as well as for proppant placement during the later stages of hydraulic fracturing. In one embodiment, the narrow tunnel (18T) has a greater length, i.e., extends a greater distance into the formation, than the wide perforation tunnel. This feature of the present invention, along with the creation of a fracture initiation area (24) at or beyond the endpoint of the wide tunnel decreases the likelihood of fracture tortuosity, micro annulus, and halo effect within the wide tunnel(s).

In one embodiment, propellants may be positioned within the perforating gun of the present invention. Once ignited, the propellant creates a propellant gas capable of pressurizing the perforation tunnels created by the shaped charges. The use of propellant in conjunction with the unique explosive charge arrangement of the present invention further encourages fracture initiation away from the well. In one embodiment, fracture initiation is encouraged in an area at or beyond the endpoint of one or more of the wide tunnels.

Figure 4:
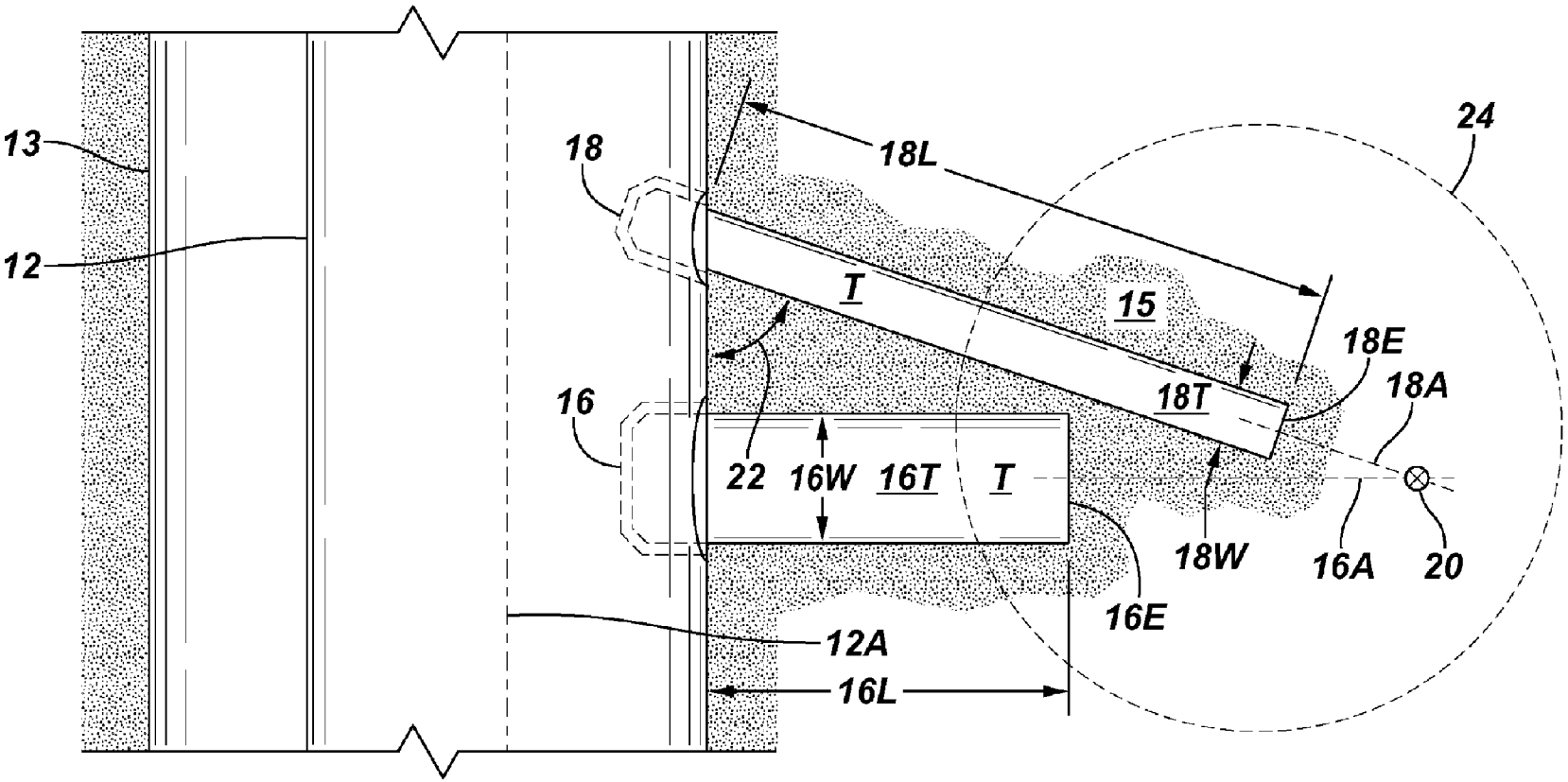
FIG. 4 is a cross-sectional view of a portion of a perforating gun of one embodiment of the present invention illustrating the intersection of perforation tunnel axes in an adjacent formation.

Referring to FIG. 4, the creation of a fracture initiation plane (24) may be encouraged without the physical intersection of the perforation tunnels. In short, the intersection of the longitudinal axes (16A and 18A, respectively) of the perforation tunnels (16T and 18T, respectively) may be sufficient to encourage fracture initiation in an area (24) at or beyond the endpoint (16E) of the wide tunnel (16T). In one embodiment, the intersection of the longitudinal axes (16A and 18A, respectively) of a plurality of perforation tunnels occurs at an intersection point (20) at or beyond the endpoint of the wide tunnel.

Figure 5:
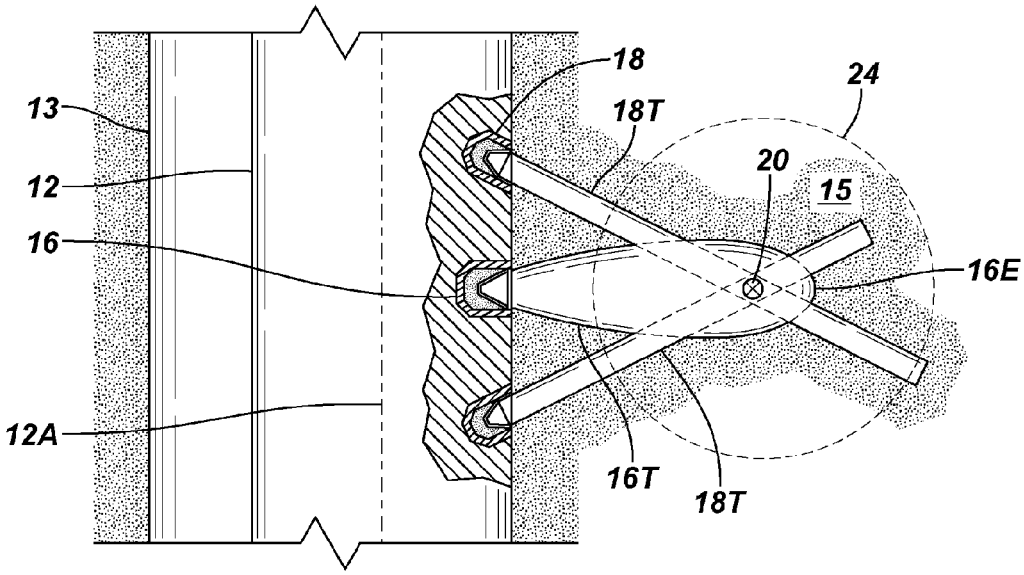
FIG. 5 is a cross-sectional view of a portion of a perforating gun of one embodiment of the present invention illustrating the intersection of perforation tunnels in an adjacent formation.

The present invention may utilize explosive charges capable of creating perforation tunnels having any number of configurations. For example, FIG. 5 illustrates an inverse carrot shaped wide perforation tunnel (16T) utilized in conjunction with multiple narrow tunnels (18T). In this embodiment, the "fat tip" of the inverse carrot shaped tunnel provides an intersection target for the narrow tunnels. This feature of the present invention allows the intersection of the tunnels to reduce the breakdown pressure near the well and shift the fracture initiation area (24) closer to the endpoint of the wide tunnel (16E).

Figure 6:
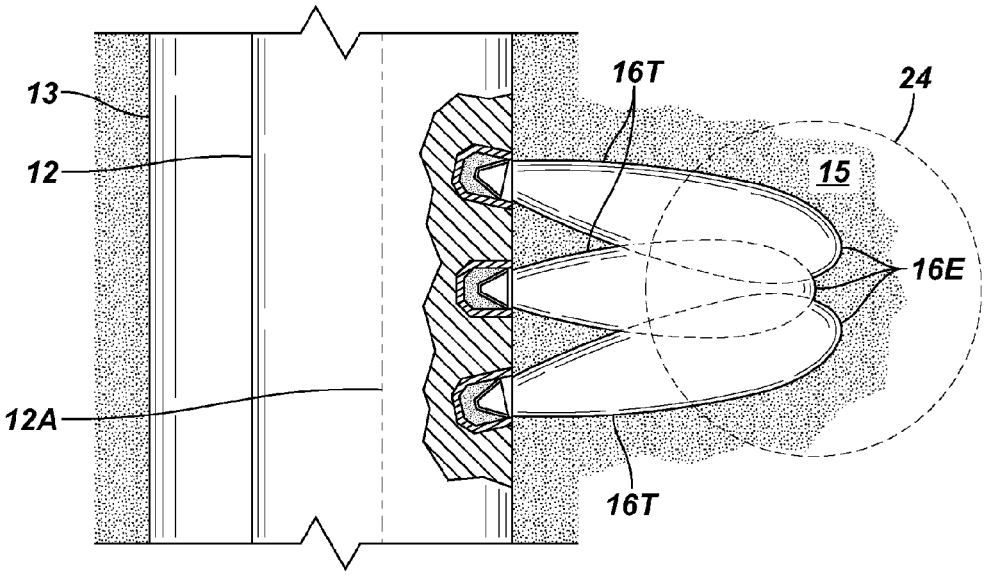
FIG. 6 is a cross-sectional view of a portion of a perforating gun of one embodiment of the present invention illustrating the intersection of perforation tunnels in an adjacent formation.
Figure 7:
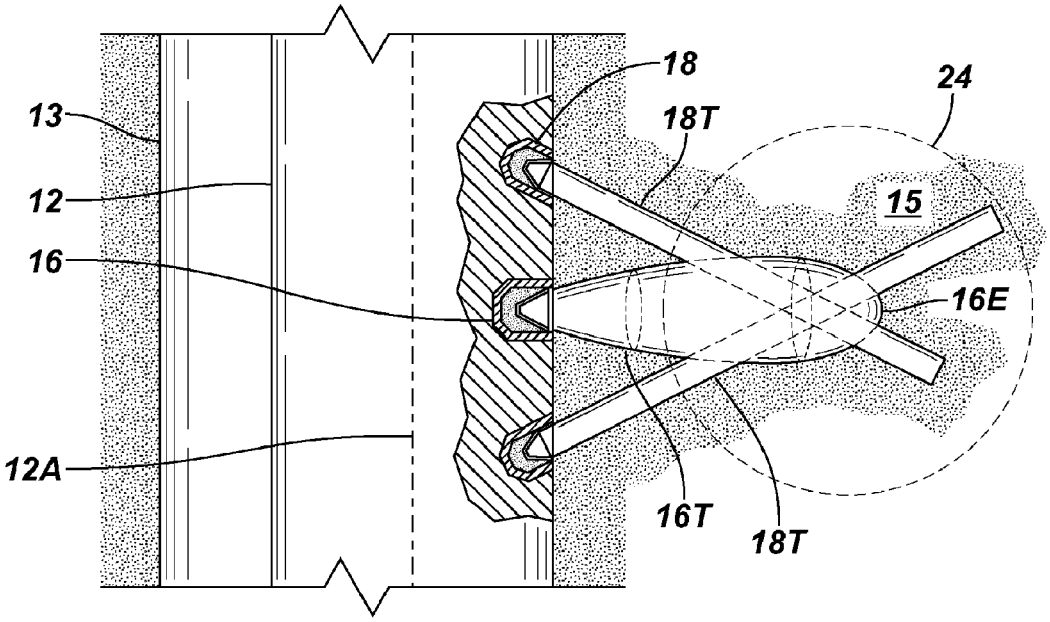
FIG. 7 is a cross-sectional view of a portion of a perforating gun of one embodiment of the present invention illustrating the intersection of perforation tunnels in an adjacent formation.

In one embodiment, a number of wide tunnels (16T) may be utilized to encourage the creation of a fracture initiation area (24) away from the well. For example, FIG. 6 illustrates a number of wide tunnels extending into the formation. In one embodiment, the creation of multiple wide tunnels within the formation is accomplished through the use of closely grouped shaped charges having relatively small focusing angles with respect to the longitudinal axis of the perforating gun. It should be understood that the wide tunnels created by the explosive charges of the present invention may have any number of configurations including, but not limited to, cylindrical, inverse carrot, and ellipsoidal configurations. For example, FIG. 7 illustrates a wide tunnel (16T) having an ellipsoidal configuration utilized in conjunction with multiple narrow tunnels (18T).

The Figures, provided herein, illustrate a limited number of explosive charge arrangements (14G) and explosive charges (14, 16, and 18) for ease of illustration only and should not be construed in a limiting sense. It should be understood that the present invention may utilize any number of explosive charge types, charge arrangements, charge phasing, and/or charge grouping in order to accomplish the goals of the invention. The detonation sequence of individual charges as well as that of groups of charges may be varied in order to maximize the creation of a fracture initiation plane and hydraulic fracturing. In one embodiment, explosive charges capable of creating narrow perforation tunnels may be detonated prior to explosive charges capable of creating wide tunnels and vice versa.

Figure 8:
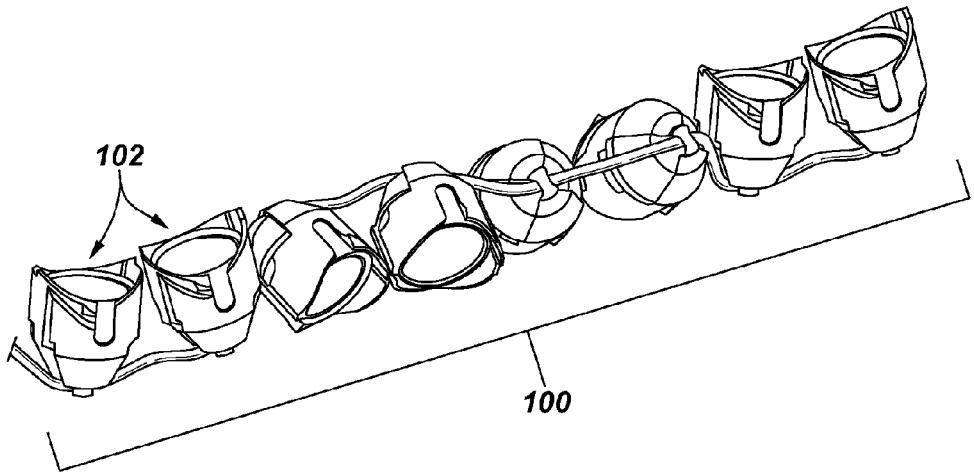
FIG. 8 is a profile view of an embodiment of a charge arrangement having similar paired charges.
Figure 9:
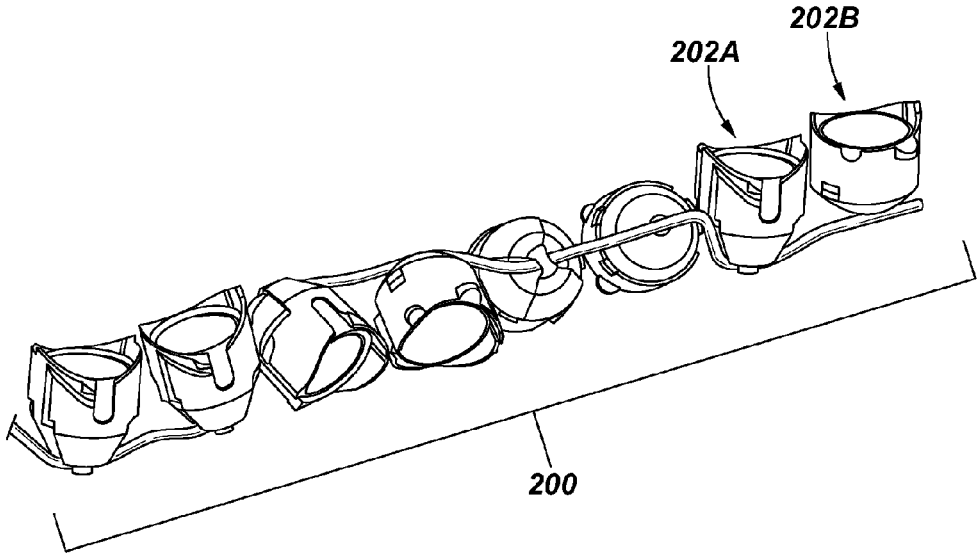
FIG. 9 is a profile view of an embodiment of a charge arrangement having differing paired charges.

In one embodiment, multiple "big hole" charges may be utilized in conjunction with multiple "deep penetrating" charges to create any number of wide and narrow perforation tunnel combinations within the formation. In one embodiment, the explosive charges create at least one perforation tunnel having an increasing cross sectional width as the tunnel proceeds into the formation. As described above, such tunnels encourage fracture initiation away from the well and may also provide a target for intersection by the narrow tunnels. For example, FIGS. 8 and 9 illustrate embodiments of perforating charge arrangements whereby paired charges are aligned to shoot into the same plane with a phasing of 120 degrees. With respect to FIG. 8, this embodiment of a perforating charge arrangement (100) comprises several sets of two similar charges (102) paired for shooting to or across a common point, whereby each charge set is oriented at 120 degrees phasing. With respect to FIG. 9, this embodiment of a perforating charge arrangement (200) comprises several sets of two different charges (202A, 202B) paired for shooting to or across a common point, whereby each charge set is oriented at 120 degrees phasing. In this embodiment, charge (202A) may be a big hole charge and charge (202B) may be a deep penetrating charge. It should be noted that other embodiments may include a different number of aligned charges oriented at different phases.

Although the invention has been described with reference to specific embodiments, this description is not meant to be construed in a limited sense. Various modifications of the disclosed embodiments, as well as alternative embodiments of the invention, will become apparent to persons skilled in the art upon reference to the description of the invention. It is, therefore, contemplated that the appended claims will cover such modifications that fall within the scope of the invention.

What is claimed is:

1. A method of creating perforation tunnels from a wellbore into the surrounding subterranean formation, the method comprising the steps of:

positioning a perforating tool in the wellbore, the tool having a grouping of shaped charges oriented to form tunnels in the formation in the same radial direction about the longitudinal axis;

creating a central tunnel in the formation; and creating a pair of tunnels intersecting at a point past an end point of the central tunnel.

2. The method of claim 1, wherein the pair of tunnels each have a diameter less than the diameter of the central tunnel.

3. The method of claim 1, further comprising the step of initiating a fracture in the formation substantially proximate to the point of intersection of the pair of tunnels.

4. The method of claim 3, wherein the pair of tunnels each have a diameter less than the diameter of the central tunnel.

5. The method of claim 3, wherein fracture is created by performing a hydraulic fracturing operation from the wellbore.

6. The method of claim 5, wherein the pair of tunnels each have a diameter less than the diameter of the central tunnel.

* * * * *